United States Patent [19]

Bogdanski et al.

[11] 4,028,973

[45] June 14, 1977

[54] CUTTING DEVICE

[75] Inventors: John J. Bogdanski, Stamford; Harold Silverman, Norwalk, both of Conn.

[73] Assignee: Pitney-Bowes, Inc., Stamford, Conn.

[22] Filed: Aug. 25, 1975

[21] Appl. No.: 607,449

[52] U.S. Cl. ..... 83/169; 83/502; 83/501; 83/504

[51] Int. Cl.[2] ..... B26D 7/08

[58] Field of Search ..... 83/169, 501, 502, 504

[56] References Cited

UNITED STATES PATENTS

| | | | |
|---|---|---|---|
| 164,920 | 6/1875 | Judson | 83/501 X |
| 2,187,129 | 1/1940 | Kramer | 83/501 X |
| 2,726,688 | 12/1955 | Flood | 83/169 |
| 3,540,334 | 11/1970 | MacLauchlan | 83/169 X |
| 3,674,065 | 7/1972 | Fairfield et al. | 83/169 X |

*Primary Examiner*—Donald R. Schran
*Attorney, Agent, or Firm*—Albert W. Scribner; William D. Soltow, Jr.; Peter Vrahotes

[57] ABSTRACT

An arrangement for dampening vibrations in and lubricating the operative edges of a pair of cooperating sheet cutting discs. A block member having a surface comprised of a solid lubricant is yieldably biased so that said surface engages the face of one of the discs that is in operative engagement with a face of the other disc.

1 Claim, 3 Drawing Figures

CUTTING DEVICE

BACKGROUND OF THE INVENTION

In certain sheet cutting devices such as envelope openers where relatively long lengths of cuts must be rapidly made it is necessary that the wetting blades or elements be both vibration free and adequately lubricated. Known slicing or cutting devices utilized use various means to reduce vibrations and to lubricate the cutting elements however such devices tend to be relatively complex, expensive and/or messy.

SUMMARY OF THE INVENTION

The primary object of this invention is to provide a simple low-cost arrangement for simultaneously lubricating and reducing vibrations in a cooperating pair of cutting discs by utilizing essentially a single block member comprised of a solid lubricant.

Other objects of the invention will become apparent as the disclosure progresses.

DETAILED DESCRIPTION OF THE INVENTION

Figure 1:
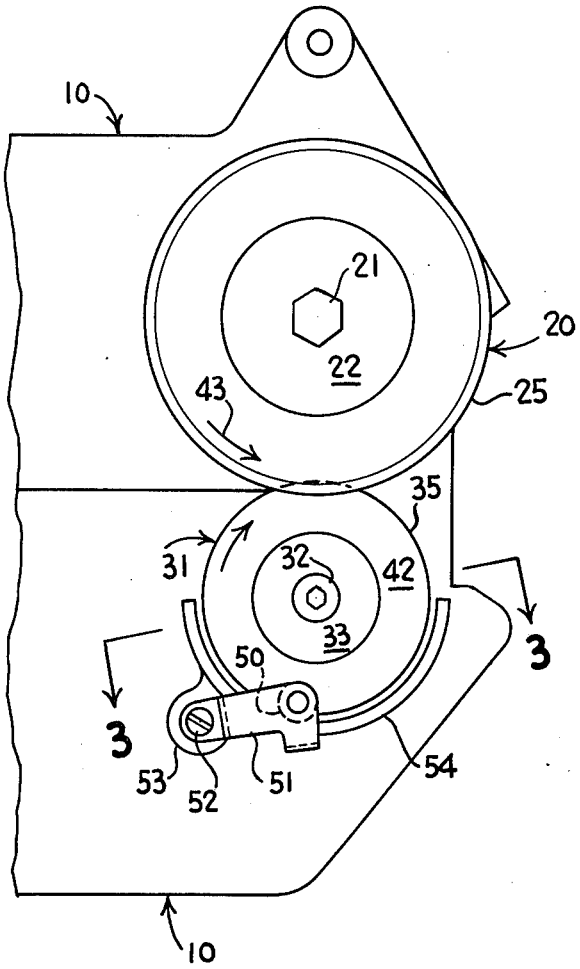
FIG. 1 is a side elevational view illustrating the instant apparatus.

Referring to the drawings there is shown a portion of a frame 10 of an envelope opening machine, said frame having two cylindrical bosses 11 and 12 integrally formed thereon. The first boss 11 rotatably supports a first shaft 13 that has a drive pulley 14 secured to one end thereof, said pulley being adapted to be driven by a belt 15. A suitable axial thrust washer is provided as indicated at 16. A first cutting disc 20 is secured to the other end of shaft 13 by any suitable means such as a machine screw 21 and opposed washer 22 and 22*a*. The disc 20 is formed with a conical periphery 23 which together with the radial inner face 24 of the disc forms a circular outer cutting edge 25.

Figure 2:
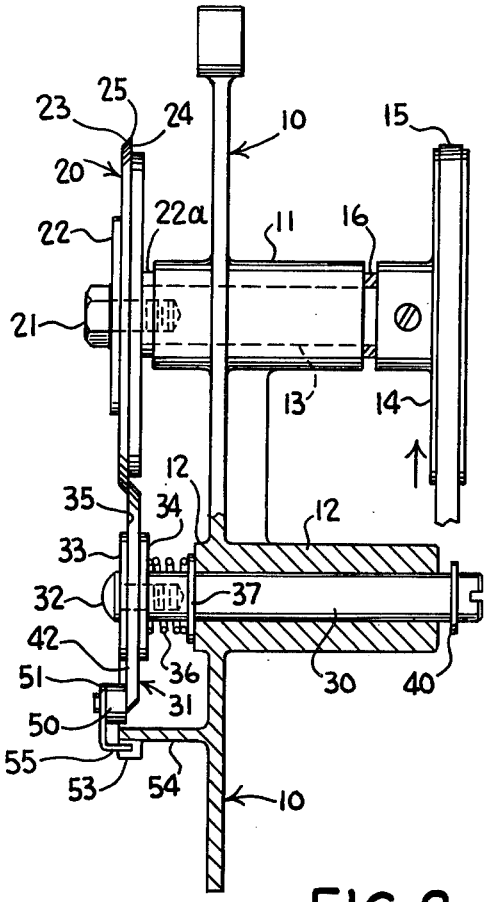
FIG. 2 is a right side view of the structure shown in FIG. 1.

The second frame boss 12 rotatably supports a second shaft 30, the latter having a second cutting disc 31, of smaller diameter than disc 20, secured to one end thereof by any suitable means such as a screw 32 and a pair of opposed washers 33, 34. The disc 31 has a circular cutting edge 35 thereon which is formed in a manner similar to that described above for cutting edge 25. The shaft 30 is axially and yieldably biased to the left, as is best seen in FIG. 2, by means of spring 36 that surrounds shaft 30 and is disposed between said washer 34 and another washer 37 that abuts the adjacent end of the machine frame boss 12. An axial retaining clip 40 is secured to the opposite end of shaft 30. As will be apparent the spring 36 urges shaft 30 axially to the left as seen in FIG. 2 so that the radially outer portion of the radial face 42 of disc 31 engages and cooperates with the corresponding portion of the radial face 24 of disc 20.

When the belt 15 is driven the shaft 13 and the disc 20 will be rotated as indicated by arrow 43 of FIG. 1, and the said peripheral contact between the discs will result in the lower disc being simultaneously rotated whereby a sheet or envelope or the like that is fed between the discs will be cut by the cooperative slitting action of said driven cutting discs 20 and 31.

When the above described cutting apparatus is driven so as to cut sheet material at a relatively rapid rate substantial disc wear occurs and considerable vibrations are generated in the disc 31 and 20. These conditions if not reduced or eliminated will cause rapid deterioration in the operational efficiency and the effective life of the apparatus.

Figure 3:
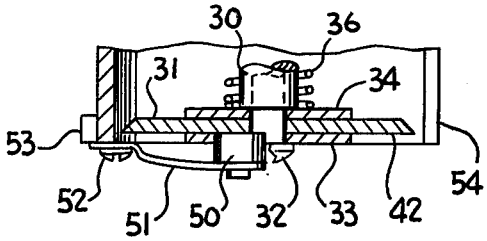
FIG. 3 is an enlarged view of a portion of the structure shown in FIG. 2.

It has been found that both the wear and vibration problems may be eliminated by the use of a single element, namely a block member 50, which is supported in cantilever fashion by a laterally flexible spring arm 51 that is secured by means of a screw 52 to a boss 53, FIGS. 2 and 3 formed on the semi-circular safety guard flange 54 which surrounds the lower half of disc 31 and which is formed as an integral part of the frame 10. The spring arm 51 serves to laterally and yieldably urge the block member 50 into engagement with the said radial face 42 of disc 31 in a region of the latter that is diametrically opposed to the region where said discs contact each other, which engagement serves to dampen any vibrations that are set up in the lower disc 31, and thus in the upper disc 20, during cutting operations. The spring arm 51 is formed with a bent off tab 55 that is adapted to limit the extent of radial inward position adjustment of the member 50 relative to the cutting disc 31. By making the block member 50 or at least the surface thereof contacting said disc face 42, out of a solid lubricant material, such as polytetrafluoroethalene, available at TEFLON[R], (a registered trademark of E. I. DuPont De Nemours Co.), the rubbing contact between the disc face 42 and the teflon material will cause the lubricant material to be metered onto said outer radial disc face 42 whereby the mutually engaging surfaces of discs 20 and 31 will be lubricated while the said vibrations are simultaneously being damped.

The simple addition of essentially one element (i.e. biased block member 50) thus substantially eliminates both the wear and vibration problems and hence the efficiency and life of the instant cutting device are inexpensively and greatly enhanced.

What is claimed is:

1. In an envelope opening device having a frame;

a first shaft rotatably mounted on said frame;

a first cutting disc secured to said shaft and having a peripheral cutting edge formed thereon;

means for driving said shaft and said cutting disc;

a second shaft rotatably mounted on said frame;

a second cutting disc secured to said second shaft and having a peripheral cutting edge formed thereon which cooperates with the said peripheral cutting edge of the first disc so that a sheet of material moving between said discs may be cut;

a block member, said member having a surface comprising a solid polytetrafluoroethalene lubricant material; and support means carried by said frame and carrying said block member for yieldably biasing said block member into engagement with said second disc, said surface of said block member thus being yieldably urged into engagement with that radial face of said second disc which contacts the corresponding face of said first cutting disc whereby lubrication of, and dampening of vibrations in, both of said discs may be simultaneously achieved.

* * * * *